US007186155B2

(12) United States Patent
Nickerson

(10) Patent No.: US 7,186,155 B2
(45) Date of Patent: Mar. 6, 2007

(54) POWER STEERING RATE CONTROLLER FOR A BOAT AND METHOD

(76) Inventor: Irvin Howard Nickerson, 819 Peacock Plz. Suite 562, Key West, FL (US) 33040

( * ) Notice: Subject to any disclaimer, the term of this patent is extended or adjusted under 35 U.S.C. 154(b) by 62 days.

(21) Appl. No.: 11/160,169

(22) Filed: Jun. 11, 2005

(65) Prior Publication Data

US 2006/0278152 A1 Dec. 14, 2006

(51) Int. Cl.
*B63H 21/22* (2006.01)

(52) U.S. Cl. ..... 440/1; 440/61 S

(58) Field of Classification Search ..... 440/1, 440/61 S

See application file for complete search history.

(56) References Cited

U.S. PATENT DOCUMENTS

| | | | | |
|---|---|---|---|---|
| 4,038,528 | A | 7/1977 | Fowler | 701/224 |
| 4,069,784 | A | 1/1978 | Hedstrom et al. | 114/144 E |
| 4,074,648 | A | 2/1978 | Reid et al. | 114/144 RE |
| 4,336,594 | A | 6/1982 | Masuzawa et al. | 701/224 |
| 4,413,215 | A | 11/1983 | Cavil et al. | 318/588 |
| 4,542,464 | A | 9/1985 | Kramer | 701/224 |
| 4,681,055 | A | 7/1987 | Cyr | 114/144 E |
| 4,747,359 | A | 5/1988 | Ueno | 114/144 B |
| 4,749,926 | A | 6/1988 | Ontolchik | 318/588 |
| 4,799,163 | A | 1/1989 | Wesner | 701/224 |
| 4,811,679 | A * | 3/1989 | Masuzawa et al. | 114/144 RE |
| 5,107,424 | A | 4/1992 | Bird et al. | 701/21 |
| 5,179,905 | A | 1/1993 | Hossfield et al. | 114/144 E |
| 5,235,927 | A | 8/1993 | Singh et al. | 114/144 E |
| 5,313,397 | A | 5/1994 | Singh et al. | 701/224 |
| 5,331,558 | A | 7/1994 | Hossfield et al. | 701/21 |
| 5,406,488 | A | 4/1995 | Booth | 701/1 |
| 5,523,951 | A | 6/1996 | Kriesgman et al. | 701/21 |
| 5,747,950 | A | 5/1998 | Friedrichsen et al. | 318/5 |
| 6,678,589 | B2 * | 1/2004 | Robertson et al. | 701/21 |
| 6,843,195 | B2 | 1/2005 | Watabe et al. | 114/144 E |

* cited by examiner

*Primary Examiner*—Stephen Avila

(57) ABSTRACT

The invention provides a device and method for producing substantially kinematic steering of a boat whose yaw rate and direction is approximately proportional to the rate and direction that a steering device such as a steering wheel is being operated. The invention provides a helmsman a precise method of steering that is relatively independent of such considerations such as the size and weight of the boat, conflicting currents and winds, windage, the size of the rudder and the overall inherent controlling characteristics of the boat. When the steering device is not being operated, the boat continues on a straight course; however, when the steering device such as the steering wheel is turned in one direction or the other, the steering rate of the boat is relatively dependent upon the rate that the steering wheel is being turned.

6 Claims, 13 Drawing Sheets

NORMAL BOAT STEERING

STEERING WHEEL POSITION AND BOAT COURSE

STEERING WHEEL POSITION, STEERING CONTROLLER OUTPUT, AND BOAT COURSE

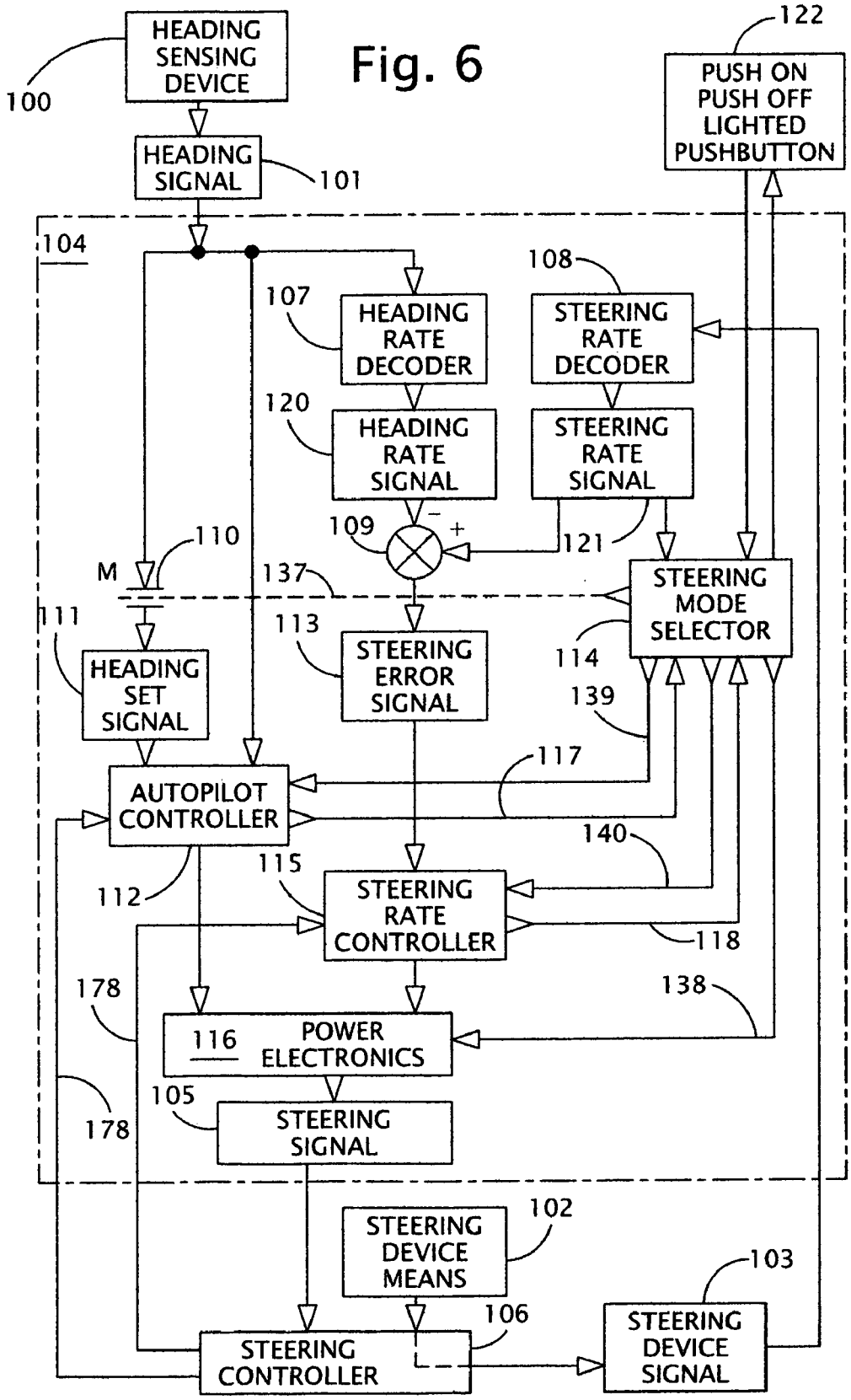
Fig. 6
HEADING SENSING DEVICE
100
HEADING SIGNAL
101
PUSH ON PUSH OFF LIGHTED PUSHBUTTON
122
104
107
HEADING RATE DECODER
108
STEERING RATE DECODER
120
HEADING RATE SIGNAL
STEERING RATE SIGNAL
109
110
121
M
137
STEERING MODE SELECTOR
111
113
STEERING ERROR SIGNAL
114
HEADING SET SIGNAL
139
117
AUTOPILOT CONTROLLER
140
115
112
STEERING RATE CONTROLLER
118
178
138
116
POWER ELECTRONICS
105
178
STEERING SIGNAL
102
STEERING DEVICE MEANS
103
106
STEERING CONTROLLER
STEERING DEVICE SIGNAL

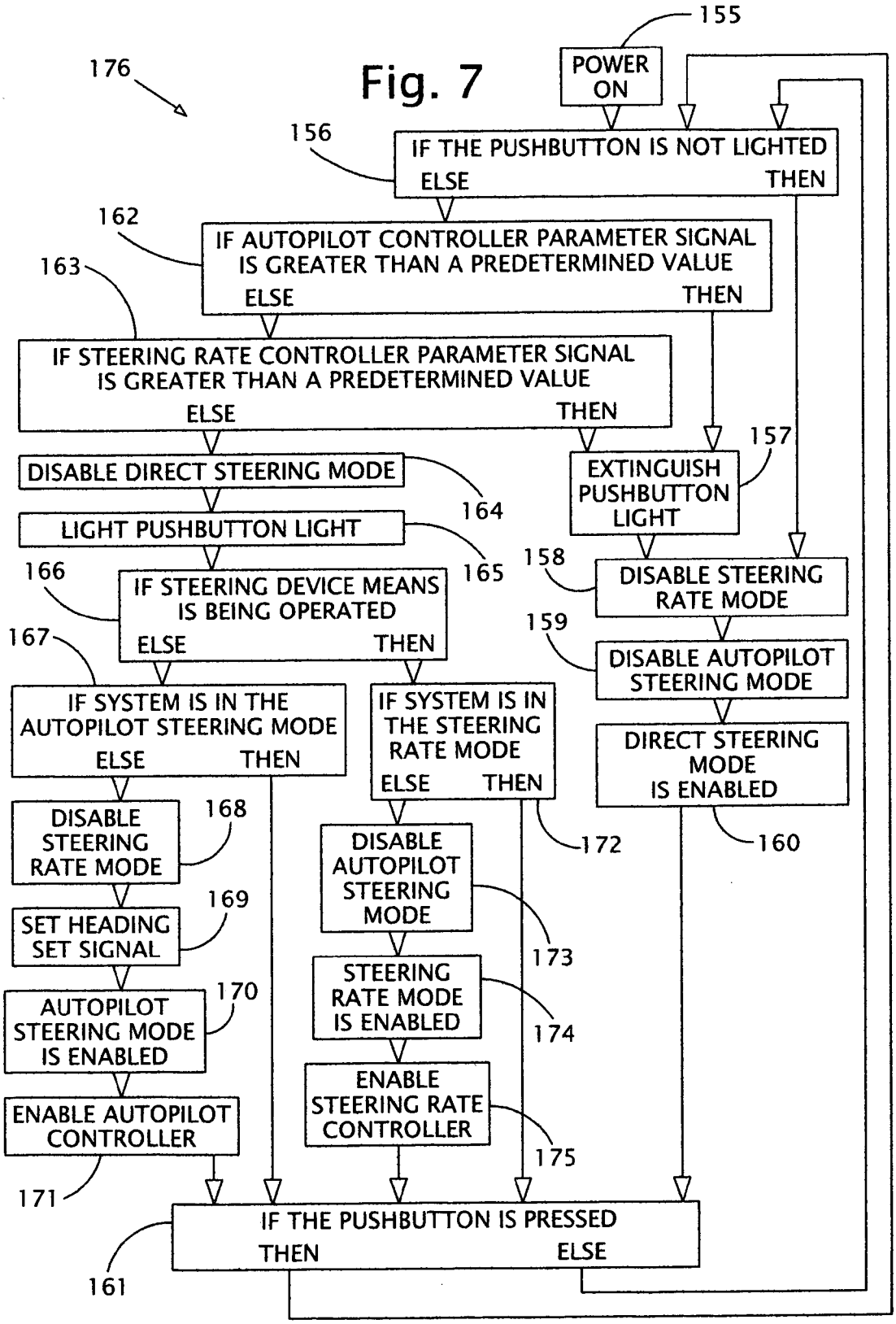
Fig. 7
176
155
POWER ON
156
IF THE PUSHBUTTON IS NOT LIGHTED
ELSE
THEN
162
IF AUTOPILOT CONTROLLER PARAMETER SIGNAL IS GREATER THAN A PREDETERMINED VALUE
ELSE
THEN
163
IF STEERING RATE CONTROLLER PARAMETER SIGNAL IS GREATER THAN A PREDETERMINED VALUE
ELSE
THEN
157
EXTINGUISH PUSHBUTTON LIGHT
DISABLE DIRECT STEERING MODE
164
LIGHT PUSHBUTTON LIGHT
165
158
DISABLE STEERING RATE MODE
166
IF STEERING DEVICE MEANS IS BEING OPERATED
ELSE
THEN
159
DISABLE AUTOPILOT STEERING MODE
167
IF SYSTEM IS IN THE AUTOPILOT STEERING MODE
ELSE
THEN
IF SYSTEM IS IN THE STEERING RATE MODE
ELSE
THEN
DIRECT STEERING MODE IS ENABLED
160
172
168
DISABLE STEERING RATE MODE
DISABLE AUTOPILOT STEERING MODE
169
SET HEADING SET SIGNAL
173
170
AUTOPILOT STEERING MODE IS ENABLED
STEERING RATE MODE IS ENABLED
174
ENABLE STEERING RATE CONTROLLER
ENABLE AUTOPILOT CONTROLLER
175
171
IF THE PUSHBUTTON IS PRESSED
THEN
ELSE
161

POWER STEERING RATE CONTROLLER FOR A BOAT AND METHOD

BACKGROUND OF THE INVENTION

The present invention relates to a device installed on a boat that is integrated with a boat autopilot and allows a boat operator to automatically override an autopilot function and turn the boat at a rate and direction that is approximately proportional to the rate and direction of a steering device such as a steering wheel. More particularly, for example, if the operator of the boat turns the steering wheel at a consistent rate of 90 degrees per second, the turn rate of the boat will be a consistent 10 degrees per second regardless of the speed of the boat. When the steering wheel motion is stopped, a heading reference is sent to an autopilot controller and the autopilot will maintain the course that was set when the steering wheel motion is stopped.

DESCRIPTION OF THE PRIOR ART

Autopilots and automatic means of steering boats and ships have been available for many decades. The prior art concentrated on maintaining the steerage of the boat on a constant course or from point to point. Modern autopilots rely on a secondary means to change the course of the vessel. This secondary means either involves changing the course setpoint and allowing the boat autopilot to reestablish the correct course or, in the case of large vessels, a selectable steering radius can be used to determine the radius of the yaw. Other methods include dodge functions and offset functions that operate in a similar manner. Additionally, when a course change is entered into the autopilot controller, the yaw rates associated with autopilots are normally preset in the parameters of the controller.

Hedstrom, et al., U.S. Pat. No. 4,069,784, Current U.S. Class 114/144E, issued Jan. 24, 1978, provides a method and device for setting preprogrammed and predetermined radius of yaw curvature. Such a device is important in large vessels operating in constricted areas where vessels may have the restricted ability to maneuver; however, this patent does readily apply to smaller vessels. This patent does not give the operator the ability to correct the radius easily under normal circumstances.

Sing, et al., U.S. Pat. No. 5,235,927, Current Class 114/144E, issued Aug. 17, 1993 provides the ability to override an autopilot by mechanically overriding the autopilot controller. This allows the operator to change course while the operator is turning the steering wheel, but when the operator releases the wheel, the vessel will return to the original course unless the operator resets the course to a new bearing. The operator is continually fighting against the actions of the rudder and the autopilot during this turning motion. The turning action of this patent does not facilitate a smooth predetermined turning radius.

Watabe, et al., U.S. Pat. No. 6,843,195, Current Class 114/144E issued Jan. 18, 2005 provides a means to change the steering rate of the boat with an outboard motor such that the steering rate at low speeds is substantially higher than the steering rate at high speeds. This is could be important from the standpoint that the steering rate at higher speeds is significantly higher for a given rudder angle. This invention incorporates this function by default for all types of steering devices including outboard motors, rudders, and jet nozzles. The steering rate of the boat is a function of how fast the steering wheel is turned and is relatively independent upon the method of turning the boat or the speed of the boat throughout the range of normal operation.

Johnson, et al., U.S. Pat. No. 5,034,895, Current Class 701/224 issued Jul. 23, 1991 integrates a special function autopilot with a device that includes a rate of turn mode when the operator also selects a specific rate of turn for a maneuver. This invention is primarily intended for large ships and is not practical for smaller boats. It does not provide a means for the operator to adjust the boat turning rate based upon the rate of turn of the steering device.

SUMMARY OF THE INVENTION

It is the object of the present invention to provide a means for the operator of the boat to easily control the steering of the boat. This device is used in conjunction with an existing autopilot of prior art design. The purpose of the autopilot portion of this invention is to maintain the course of the boat when the steering wheel, or other steering device, is not being operated. When the steering wheel is operated, the autopilot portion of the present invention is disabled and the steering rate portion of the present invention is enabled. This is accomplished by converting the rate and direction of turning of the steering wheel, or other steering device, into a boat steering action that can turn the boat at a rate and direction that is relatively proportional to the rate and direction that the steering wheel is being turned.

An operator simply needs to turn the steering wheel in the desired direction. The rate of speed that the operator turns the steering wheel determines the rate of speed that the boat will turn regardless of the other factors that affect the boat turning rate. At the moment the operator ceases to turn the steering wheel, a heading setpoint will be set and the autopilot of prior art design will steer the boat on the previously described heading setpoint.

Consequently, an operator of the boat does not need to have the detailed knowledge of the effect of rudder movement on the boat with respect to the size of the rudder, the size and weight of the boat, the position of the rudder, and the speed of the boat. Nor does the operator need to be aware of the steering compensations that are normally necessary to enter and exit a turn.

Additional circuits determine if the controlling circuits are operating in a consistent manner that would indicate that the boat is being operated in a normal forward direction and is not stationary, operating in an abnormally slow manner, or operating in reverse.

If the controlling circuits are not operated in a consistent manner, the boat is considered to be operating in an abnormal mode and the steering mode defaults to a direct steering mode whereby turning the steering wheel directly turns the rudder as if there is a direct connection between the steering wheel and the rudder.

BRIEF DESCRIPTION OF THE DRAWINGS

FIG. 6 is a operational block diagram of the preferred embodiment of the proposed invention that focuses on the operation of a central control unit 104.

FIG. 7 is a flow diagram of the invention that defines how the different steering modes are selected.

DETAILED DESCRIPTION OF PREFERRED EMBODIMENT

Figure 1:
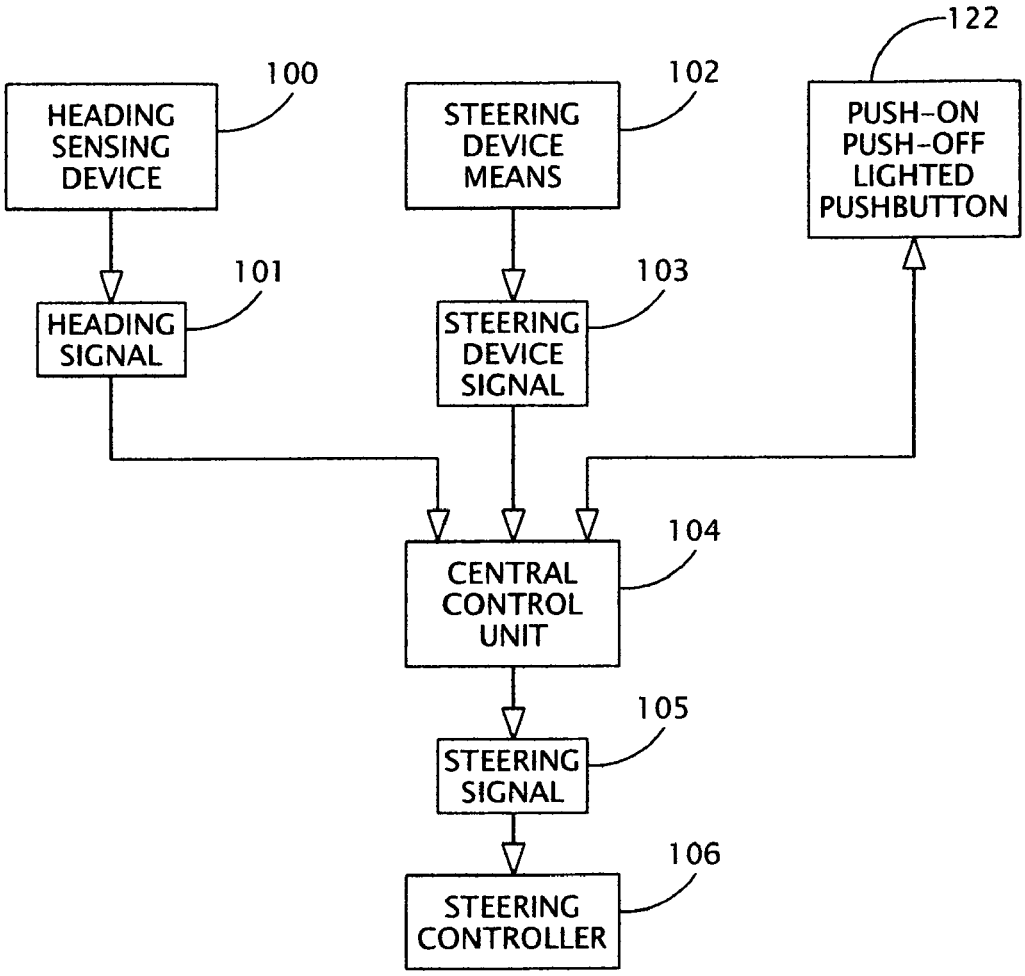
FIG. 1 shows a basic functional block diagram of the proposed invention.

Listed numerically below with reference to the drawings are terms used to describe features of this invention. These terms and numbers assigned to them designate the same features throughout this description:

100. Heading sensing device
101. Heading signal
102. Steering device means
103. Steering device signal
104. Central control unit
105. Steering signal
106. Steering controller
107. Heading rate decoder
108. Steering rate decoder
109. Difference amplifier
110. Momentary heading set contact
111. Heading set signal
112. Autopilot controller
113. Steering error signal
114. Steering mode selector
115. Steering rate controller
116. Power electronics
117. Autopilot controller parameter signal
118. Steering rate controller parameter signal
119. Steering wheel
120. Heading rate signal
121. Steering rate signal
122. Push on push off lighted pushbutton
123. Steering wheel position
124. Boat course
125. Steering controller output
126. Steering wheel turning rate
127. Steering lever position
137. Momentary heading set signal
138. Direct steering mode signal
139. Autopilot controller mode signal
140. Steering rate controller mode signal
145. Helm pump
146. Selector valve
147. Hydraulic motor
148. Hydraulic pump motor
149. Hydraulic pump
150. Hydraulic pump speed encoder
151. Bi-directional relief valve
152. Hydraulic steering cylinder
153. Rudder
154. Hydraulic motor speed encoder
155. Step 155
156. Step 156
157. Step 157
158. Step 158
159. Step 159
160. Step 160
161. Step 161
162. Step 162
163. Step 163
164. Step 164
165. Step 165
166. Step 166
167. Step 167
168. Step 168
169. Step 169
170. Step 170
171. Step 171
172. Step 172
173. Step 173
174. Step 174
175. Step 175
176. Flow diagram of the steering mode selector
177. Shaft encoder
178. Hydraulic pump speed feedback signal
179. Steering lever
180. Steering lever encoder
181. Rudder position encoder
182. Rudder position feedback signal
185. Class D converter
186. Power amplifier
187. Power H bridge amplifier
188. Autopilot control signal
189. Steering rate control signal
190. Steering device control signal
191. Steering device controller Listed in alphabetical order below are the terms and definitions used in the description and drawings below with reference to other terms and drawings used to describe features of this invention. These terms and definitions designate the same features throughout this description:

| Term | Definition |
|---|---|
| Automatic mode | An automatic mode is in effect when a push on push off lighted pushbutton is lighted. The device is in an autopilot steering mode if the steering device |

-continued

| Term | Definition |
|---|---|
| | means 102 is not being activated or in a steering rate mode if the steering device means 102 is being activated. In the automatic mode, the direct steering mode is disabled. |
| Autopilot control signal | An autopilot control signal 188 refers to the signal output from the autopilot controller 112. |
| Autopilot controller | The autopilot controller 112 refers to the fundamental design of any prior art autopilot controller. |
| Autopilot controller mode signal | An autopilot controller mode signal 139 refers to the signal from the steering mode selector 114 to enable or disable the autopilot controller 112. |
| Autopilot controller parameter signal | An autopilot controller parameter signal 117 refers to a combination of proportional, integral, and derivative terms of a typical PID controller or adaptive PID controller and is used to communicate to a steering mode selector 114 that the autopilot controller 112 is either operating normally or is operating outside normal parameters. |
| Autopilot steering mode | The autopilot steering mode is in effect whenever the invention is in the automatic mode and the steering device means 102 is not being actuated. |
| Bi-directional relief valve | A bi-directional relief valve 151 is used to prevent over pressurizing the hydraulic lines and a hydraulic steering cylinder 152 during steering operations. |
| Boat course | The boat course 124 is the direction that the boat is heading. |
| Central control unit | The central control unit 104 receives a heading signal 101, a steering device signal 103 and information from the push on push off lighted pushbutton 122 and provides a steering signal 105 to the steering controller 106. The central control unit 104 also determines the mode of operation of the invention. |
| Class D converter | A class D converter 185 is used to convert the autopilot control signal 188 or a steering rate control signal 189 into a class D signal to be applied to a power H bridge amplifier 187. |
| Difference amplifier | A difference amplifier 109 calculates a steering error signal 113 which is the difference between a heading rate signal 109 and a steering rate signal 121. |
| Direct steering mode | The direct steering mode is in effect whenever the push on push off lighted pushbutton 122 is not lighted. In the direct steering mode, the steering device means 102 causes the steering controller 106 to steer the boat as if the steering device means 102 was directly connected to the steering controller 106. |
| Direct steering mode signal | A direct steering mode signal 138 directs the power amplifier 186 to energize a selector valve 146 when the system is in the autopilot steering mode or the steering rate mode. When the system is in the direct steering mode, the signal directs the power amplifier 186 to de-energize the selector valve 146. |
| Flow diagram of the steering mode selector | A flow diagram of the steering mode selector 176 (FIG. 7) provides a logical diagram of the conditions necessary to set and maintain the direct steering mode, the autopilot steering mode and the steering rate mode. |
| Heading rate decoder | A heading rate decoder 107 calculates the rate of change of the heading signal 101. to calculate the heading rate signal 120. |
| Heading rate signal | The heading rate signal 120 is calculated |

-continued

| Term | Definition |
|---|---|
| | by the heading rate decoder 107 and is applied to the difference amplifier 109. |
| Heading sensing device | A heading sensing device 100 consists of a global positioning system receiver, a tilt compensated compass, a gyroscope or any other device that can provide a consistent heading of the boat under conditions of pitch and roll. |
| Heading set signal | A heading set signal 111 is the reference heading that is set for the autopilot controller 112. The heading set signal 111 is set whenever the invention is initially energized or when the invention is in the automatic mode and the steering device means 102 has ceased to be operated. |
| Heading signal | The heading signal 101 is the signal representing the pitch and roll compensated heading of the boat obtained from the heading sensing device 100 and is applied to the heading rate decoder 107, the autopilot controller 112 and to the heading set signal 111 when a momentary heading set signal 137 is activated. |
| Helm pump | A helm pump 145 is a modified bi-directional hydraulic pump that is used in conjunction with a steering wheel 119 to provide a possible component as the steering device means 102. |
| Hydraulic motor | A hydraulic motor s147 is used in conjunction with a hydraulic motor speed encoder 154 to determine the hydraulic oil flow from the helm pump 145 in the preferred embodiment. |
| Hydraulic motor speed encoder | The hydraulic motor speed encoder 154 is used to determine the speed of the hydraulic motor 147 which indirectly measures hydraulic oil flow which in turn, reflects the speed that the steering wheel 119 is being turned. |
| Hydraulic pump | A hydraulic pump 149 is used to provide the hydraulic energy necessary to position the hydraulic steering cylinder 152 and subsequently a rudder 153. |
| Hydraulic pump motor | A hydraulic pump motor 148 is used to power the hydraulic pump 149. |
| Hydraulic pump speed encoder | A hydraulic pump speed encoder 150 is used to provide speed feedback to the autopilot controller 112 and the steering rate controller 115 to stabilize the operation of the autopilot controller 112 and the steering rate controller 115 when used in the preferred embodiment. |
| Hydraulic pump speed feedback signal | A hydraulic pump speed feedback signal 178 provides an electrical signal representing motor speed to the autopilot controller 112 and the steering rate controller 115 to indicate the speed of the hydraulic pump motor 148. |
| Hydraulic steering cylinder | The hydraulic steering cylinder 152 provides the power to turn the rudder 153. |
| Momentary heading set contact | A momentary heading set contact 110 provides a means to set the heading set signal 111 from the heading signal 101 either when the invention is initially energized or when the system shifts from the steering rate mode to the autopilot steering mode. |
| Momentary heading set signal | The momentary heading set signal 137 is generated in the steering mode selector 114 to close the momentary heading set contact 110 to apply the heading signal 101 to the heading set signal 111. |
| Power electronics | The power electronics 116 generate the necessary power signals from the steering |

-continued

| Term | Definition |
|---|---|
| | device means 102, the autopilot controller 112, or the steering rate controller 115 to generate the steering signal 105. |
| Power H bridge amplifier | The power H bridge amplifier 187 converts the class D signals from the class D converter 185 into power signals sufficient to drive the hydraulic motor 147. |
| Push on push off lighted pushbutton | The push on push off lighted pushbutton 122 provides a means to select the direct steering mode or the automatic mode. When the light is lighted, the invention is in the automatic mode and when the light is not lighted, the invention is in the direct steering mode. |
| Rudder | The rudder 153 describes a generic means to turn the boat. |
| Rudder position encoder | A rudder position encoder 181 provides a means to measure the position of the rudder 153. |
| Rudder position feedback signal | A rudder position feedback signal 182 is the signal from the rudder position encoder 181 and is used to provide a control signal to a steering device controller 191 when used with a steering lever 179. |
| Selector valve | The selector valve 146 provides a means to select the direct steering mode or the automatic mode of operation in the preferred embodiment. When the selector valve 146 is de-energized, the invention is in the direct steering mode, When the selector valve 146 is energized, the invention is in the automatic mode. |
| Shaft encoder | The shaft encoder 177 provides an encoded electrical signal that indicates the speed and direction of the shaft of the steering wheel 119. |
| Steering controller | The steering controller 106 consists of the hydraulic, mechanical and electrical devices used to actually steer the boat and includes one or more hydraulic motors and pumps, one or more selector valves, one or more hydraulic cylinders or actuators, and includes the device by which the boat is physically being steered which includes a rudder 153, positioning an outboard, or other device that is in contact with the water and determines the heading of the boat. |
| Steering controller output | The steering controller output 125 refers to the output of the steering controller 106 during a steering maneuver defined by FIGS. 3, 4, and 6. |
| Steering device control signal | A steering device control signal 190 is obtained from the steering device controller 191 and provides steering information to the power electronics 116 is used in an alternative embodiment that uses the steering lever 179 as the steering device means 102. The steering device control signal 190 is only used when the device is in the direct steering mode. |
| Steering device controller | The steering device controller 191 is used in an alternate embodiment that uses the steering lever 179 to operate the invention in the direct steering mode. The steering device controller 191 uses the steering rate signal 121 and the steering mode selector 114 to develop the steering device control signal 190. |
| Steering device means | The steering device means 102, is the means by which a boat operator is able to control the direction of the boat and may include the steering wheel 119, the |

-continued

Figure 5:
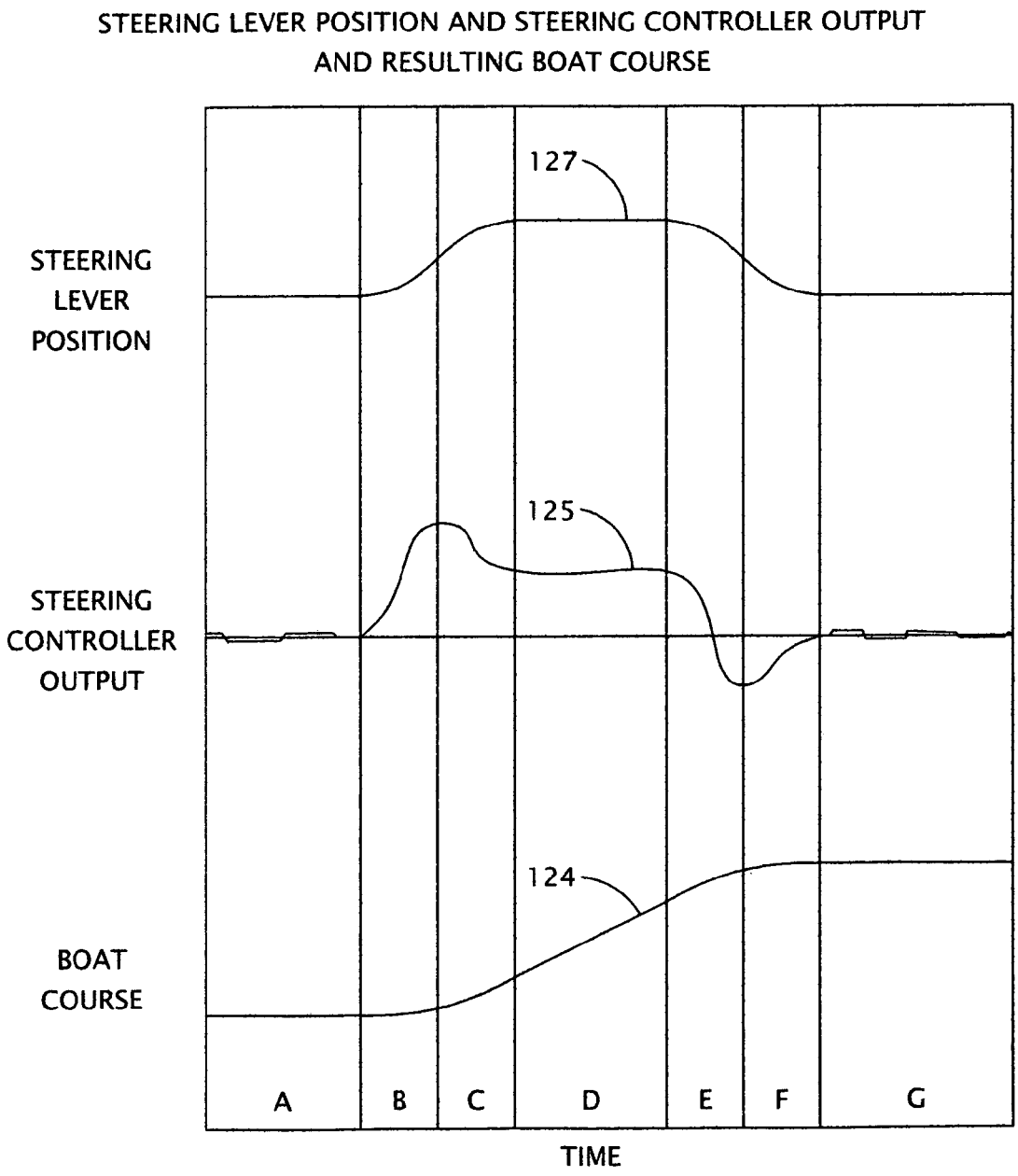
FIG. 5 is a graph illustrating the use of a steering lever 179 to control the change in the course of the boat, and shows a relative steering lever position 127, the approximate steering controller output 125, and the resulting boat course 124.

| Term | Definition |
|---|---|
| | steering lever 179, a steering knob, a tiller or any device used by the operator to steer the boat. |
| Steering device signal | The steering device signal 103 is the signal that is output by the steering device means 102 and applied to a steering rate decoder 108 while in the automatic mode or directly to the power electronics 116 if the system is in the direct steering mode. |
| Steering error signal | The steering error signal 113 is derived from the difference amplifier 109 and is applied to the steering rate controller 115. |
| Steering lever | The steering lever 179 provides a means to steer the boat by positioning the lever. |
| Steering lever encoder | A steering lever encoder 180 provides a means to convert the steering lever position 127 into the steering rate signal 121. |
| Steering lever position | The steering lever position 127 is shown in FIG. 5 to show the relationship between the steering lever position 127 and the resulting steering controller output 125, and the resulting boat course 124. |
| Steering mode selector | The steering mode selector 114 is the device by which the system is set to the direct steering mode, the autopilot steering mode, or the steering rate mode. |
| Steering rate control signal | The steering rate control signal 189 is the resultant control signal from the steering rate controller 115 and is applied to the class D converter 185 |
| Steering rate controller | The steering rate controller 115 is used in the steering rate mode to control the rate of turn of the boat. The steering rate controller 115 receives the steering error signal 113 and is applied to the class D converter 185. |
| Steering rate controller mode signal | A steering rate controller mode signal 140 consists of the signal that is used to enable the steering rate controller 115. |
| Steering rate controller parameter signal | A steering rate controller parameter signal 118 consists of a composite signal of the PID components of the steering rate controller 115 and is evaluated by the steering mode selector 114 to determine if the steering rate controller 115 is operating in a correct and consistent manner. |
| Steering rate decoder | The steering rate decoder 108 calculates the rate of change of the steering device signal 103 to derive the steering rate signal 121. |
| Steering rate mode | The steering rate mode is in effect whenever the invention is in the automatic mode and the steering device means 102 is being actuated. |
| Steering rate signal | The steering rate signal 121 is derived from the steering rate decoder 108 and is essentially the first derivative of the steering device signal 103 and is subsequently applied to the steering mode selector 114 and difference amplifier 109. |
| Steering signal | The steering signal 105 is the output signal from the power electronics 116 and is subsequently applied to the steering controller 106. The steering signal 105 consists of signals to power the hydraulic pump 149 and to power the selector valve 146. |
| Steering wheel | The steering wheel 119 is used as in the preferred embodiment as the steering device means 102. |
| Steering wheel position | The steering wheel position 123 is shown |

-continued

Figure 2:
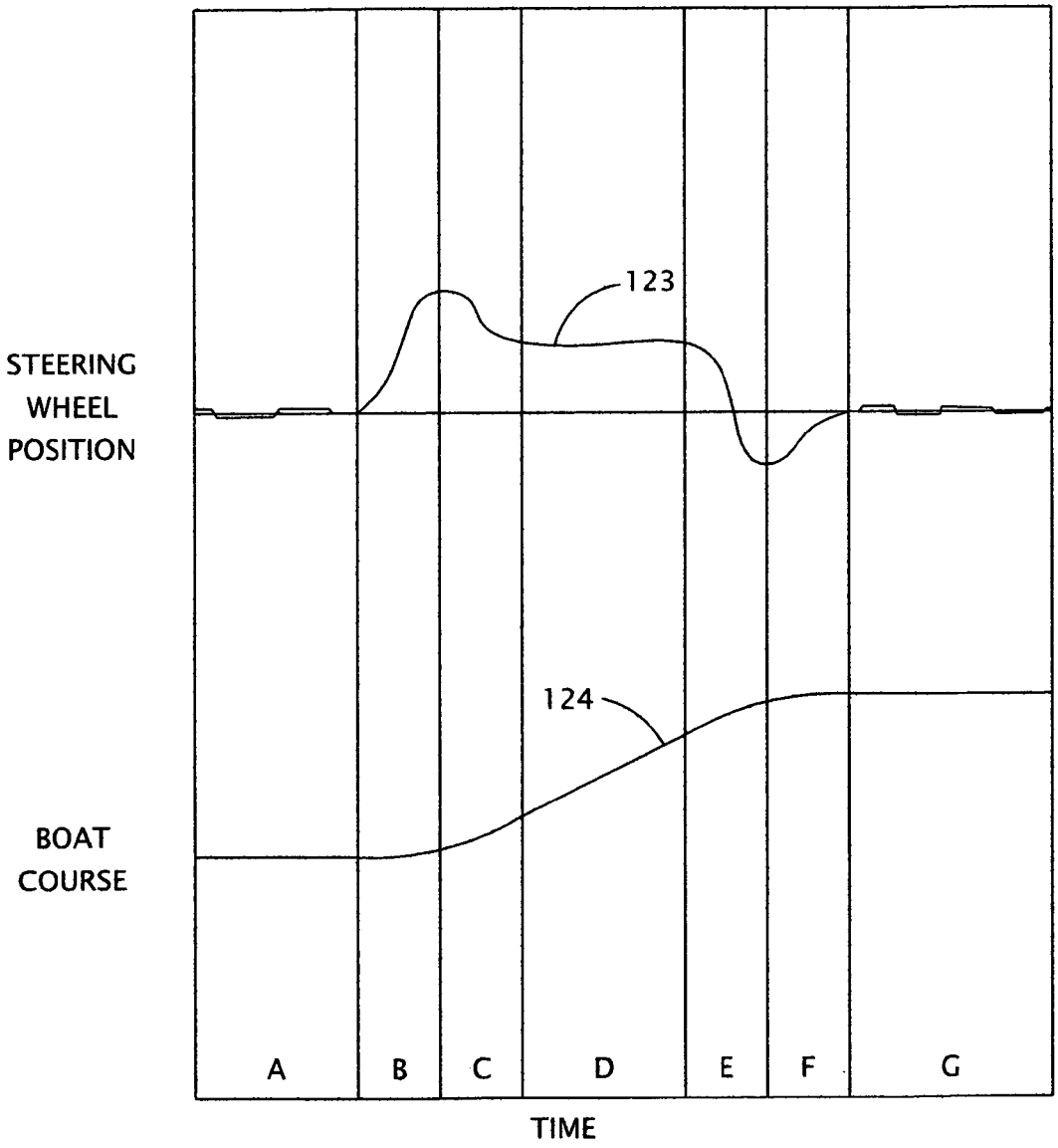
FIG. 2 is a graph illustrating a steering wheel position 123 that corresponds to a boat course 124 under normal steering conditions.
Figure 3:
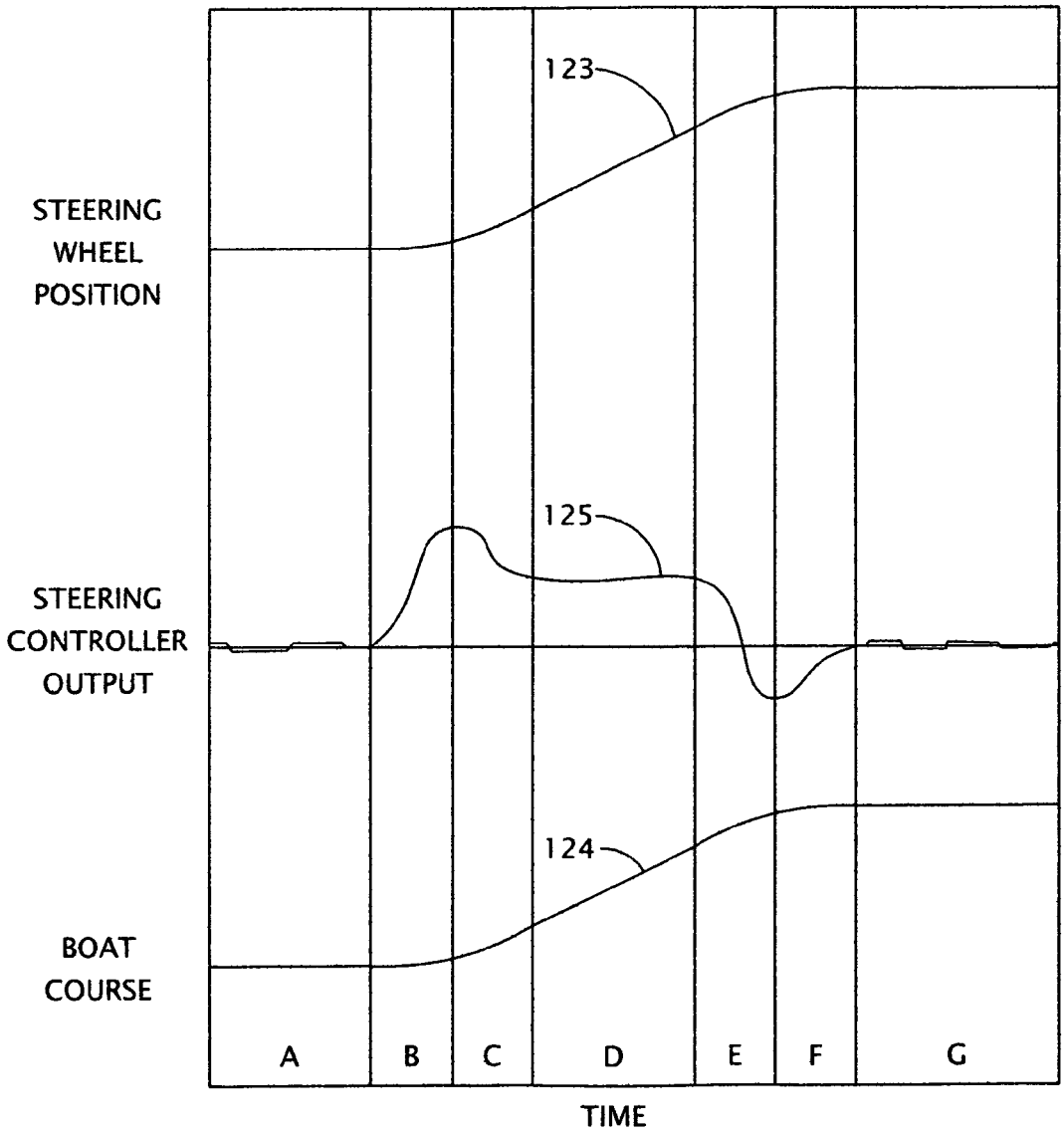
FIG. 3 is a graph illustrating the use of the invention to control the change of course of a boat, and shows the relative steering wheel position 123 and an approximate resulting steering controller output 125, and the approximate resulting boat course 124.
Figure 4:
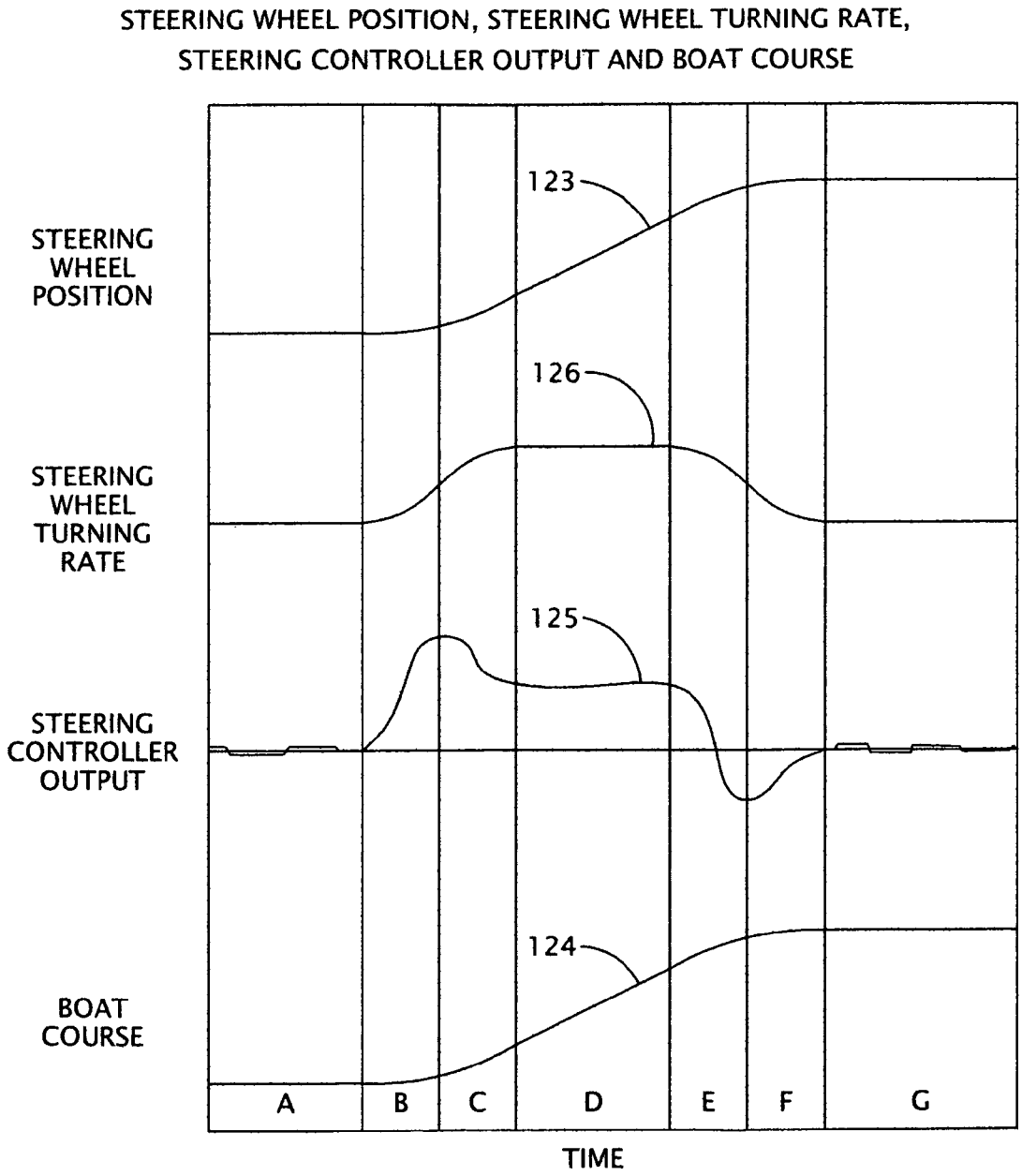
FIG. 4 is a graph illustrating the use of the invention to control the change in the course of the boat, and shows the relative steering wheel position 123, an approximate steering wheel turning rate 126, the approximate steering controller output 125, and the approximate resulting boat course 124.

| Term | Definition |
|---|---|
| | on the graphs on FIGS. 2, 3, and 4 to show the relationship of the steering wheel position 123 to other parameters on the respective graphs. |
| Steering wheel turning rate | The steering wheel turning rate 126 is shown on the graph on FIG. 4 and its relationship to the steering wheel position 123. |

FIG. 1 shows a functional block diagram of the invention. The heading sensing device 100, provides the tilt and trim compensated boat heading signal 101 to the central control unit 104. The steering device means 102 that can consist of the steering wheel 119, the steering lever 179 or other steering means provides the steering device signal 103 consisting of a signal that represents the direction and rate of actuation of the steering device means 102 to the central control unit 104. The push on push off lighted pushbutton 122 allows the operator to either select the automatic mode or the direct steering mode. The push on push off lighted pushbutton 122 also informs the operator of the mode of operation and communicates with the central control unit 104. The central control unit 104 sends the steering signal 105 to the steering controller 106 that physically controls the direction of the boat.

Referring to FIG. 2, a graph is displaying the steering wheel position 123 of the boat and the resulting boat course 124. The graph assumes no wind with calm seas and no waves and describes the actions of the boat operator without the assistance of an autopilot or other automatic steering device. The change in course is arbitrary; however, any change in course that provides a smooth course transition requires the approximate steering wheel transitions shown in FIG. 2. FIG. 2, section A shows that the steering wheel position 123 must be frequently adjusted to maintain the boat course 124. FIG. 2, section B shows a turn being initiated by turning the steering wheel 119 abruptly in a direction to initiate the turn of the boat. The larger boat with a proportionally greater mass and the proportionally smaller rudder 153 will require a greater steering wheel angle than the smaller boat with a proportionally smaller mass and the proportionally larger rudder 153. As shown in FIG. 2, Section C, as soon as the boat begins the turn, the steering wheel position 123 is backed off to establish the rate of the turn. FIG. 2, Section D, shows the turn rate established and continued. FIG. 2, Section E, shows the steering wheel 119 being turned in the opposite direction to slow the turning of the boat. FIG. 2, Section F, backs off the steering wheel 119 to settle the boat on the new boat course 124. FIG. 2, Section G shows the steering wheel position 123 maintaining a new course.

Referring to FIGS. 3 and 6, prior art autopilots use a variety of methods to maintain the course of the boat. This invention proposes a useful and original method to replace or augment the inconsistent methods that prior art autopilots incorporate to change the course of the boat. In particular, this invention strives to simplify the operation of changing the boat course 124 to that shown in FIG. 3 in Sections A, B, C, D, E, and F. FIG. 3 shows the steering wheel position 123 being moved in one direction and slowly increasing in speed in Sections B and C until the speed of movement is constant in Section D. The steering wheel position 123 movement is then slowly decreased in Sections E and F until the speed of movement of the steering wheel position 123 is zero and a new heading set signal 111 is electrically transmitted to the autopilot controller 112. While the steering wheel 119 shows a smooth transition from one course to another, the steering controller output 125 provides an output similar to the steering wheel position 123. in FIG. 2.

As shown in FIGS. 4 and 5, the steering wheel turning rate 126 corresponds approximately to the first derivative of the steering wheel position 123 which also corresponds approximately to the steering lever position 127 in FIG. 5. Thus, as shown in FIG. 5, the steering lever position 127 can also provide the same turning characteristics as the steering wheel position 123 shown in FIG. 4.

As shown in the basic block diagram in FIG. 1, the central control unit 104 has three major signal inputs, the heading signal 101 obtained from the heading sensing device 100, the steering device signal 103 obtained from the steering device means 102, and signals from the push on push off lighted pushbutton 122. The heading sensing device 100 consists of the tilt compensated compass in conjunction with the global positioning system receiver and may include the gyroscope or other device that can provide a tilt and roll compensated heading. The steering device means 102 consists of the steering wheel 119, the steering lever 179 or other boat steering means. The push on push off lighted pushbutton 122 provides a means for the boat operator to manually turn on and turn off the automatic steering and turning features of the device while providing the boat operator with a light to inform the operator of the status of operation of the device. If the light is on, the automatic steering and turning features are enabled; conversely if the light is off, the automatic steering and turning features are disabled. The central control unit 104 provides the steering signal 105 to the steering controller 106 which is used to steer the boat.

There are two basic modes of operation for the device that is controlled by the central control unit 104. The first basic mode is the automatic mode which includes the autopilot steering mode and the steering rate mode. The second basic mode is the direct steering mode and is used provide a standard method of steering.

The automatic mode of steering provides two modes of operation. The autopilot steering mode provides a means to maintain the boat course and is a well documented prior art. The steering rate mode controls the rate of steering when the steering device means 102 is being used.

Referring to FIG. 6, the steering rate mode is normally in effect when the device has been enabled by the push on push off lighted pushbutton 122 and is initiated by actuating the steering device means 102 by turning the steering wheel 119 or by directing the steering lever 179 in one direction or the other. This action sends the resulting steering device signal 103 to the to the steering rate decoder 108 that essentially takes the first derivative of the steering device signal 103 to provide the steering rate signal 121. The steering rate signal 121 is sent to the steering mode selector 114 and also to the difference amplifier 109.

Referring to FIG. 6, the heading signal 101 obtained from the heading sensing device 100 and is sent to the heading rate decoder 107 that essentially takes the first derivative of the heading signal 101 to provide the heading rate signal 120 and applies this signal to the difference amplifier 109. The difference amplifier 109 subtracts the heading rate signal 120 from the steering rate signal 121 to produce the steering error signal 113. The steering error signal 113 is applied to the steering rate controller 115 that is essentially a PID controller. The steering rate controller 115 is enabled by the steering mode selector 114 by means of the steering rate controller mode signal 140. The output of the steering rate controller 115 provides the control signal to the power electronics 116. The power electronics 116 convert the small control signals from the steering rate controller 115 into the steering signal 105 that consists of signals sufficient to operate hydraulic pumps and solenoid valves. The steering signal 105 powers the components of the steering controller 106.

When the steering mode selector 114 senses that the steering rate signal 121 has decreased to approximately zero, the steering mode selector 114 provides the momentary heading set signal 137 to close the momentary heading set contact 110 to allow the heading signal 101 to be set into the heading set signal 111 to be the heading reference for the autopilot controller 112. Additionally, the steering mode selector 114 enables the autopilot controller 112 by means of the autopilot controller mode signal 139.

Referring to FIG. 6, the autopilot steering mode is normally in effect when the device has been enabled by the push on push off lighted pushbutton 122, the push on push off lighted pushbutton 122 is lighted, and the steering device means 102 has not been actuated. The autopilot controller 112 accepts the heading signal 101 from the heading sensing device 100. When the device is initially activated by pressing the push on push off lighted pushbutton 122, the heading signal 101 is applied to the heading set signal 111 by means of the momentary heading set signal 137 and the momentary heading set contact 110. The output of the autopilot controller 112 is applied to the power electronics 116 to produce the steering signal 105 to the steering controller 106. The autopilot controller 112 is deactivated by either pressing the push on push off lighted pushbutton 122, activating the steering device means 102, or by stopping the boat or operating the boat in reverse. If the device is deactivated by operating the steering device means 102, it is automatically reactivated while the push on push off lighted pushbutton 122 is lighted and the steering device means 102 is not being actuated.

Referring to FIG. 6, the direct steering mode is enabled whenever both the steering rate mode and the autopilot steering mode are disabled. A number of conditions can enable the direct steering mode and include pressing the push on push off lighted pushbutton 122 to extinguish the light, stopping the boat, operating the boat in reverse or operating the boat at a very low speed or loss of power to the device. If any of the conditions occur that enable the direct steering mode, the steering mode selector 114 disables the autopilot controller 112 with the autopilot controller mode signal 139 and disables the steering rate controller 115 with the steering rate controller mode signal 140. Additionally, the steering mode selector 114 enables the steering device signal 103 to directly operate the power electronics 116 by means of the direct steering mode signal 138. The direct steering mode enables the operator to operate the boat in a normal steering manner as if no automatic features were available.

Referring to FIG. 6 the steering mode selector 114 is configured to determine the mode of operation of the device. As previously described, if the push on push off lighted pushbutton 122 is lighted, the device is either in the steering rate mode or the autopilot steering mode. The steering mode selector 114 is also able to determine if the autopilot controller 112 and steering rate controller 115 are operating properly by monitoring the autopilot controller parameter signal 117 and the steering rate controller parameter signal 118. The autopilot controller parameter signal 117 is calculated from the autopilot PID controller parameters obtained from the autopilot controller 112. The steering rate controller parameter signal 118 is calculated from the steering rate PID controller parameters obtained from the steering rate controller 115. If either parameter signal is greater than a predetermined setpoint, the steering mode selector 114 has determined that the boat is either stopped, is operating in reverse, or is being maneuvering in a manner that neither the steering rate controller 115 nor the autopilot controller can provide the reliable steering signal 105. Under these conditions, the steering mode selector 114 will disable the steering rate mode and the autopilot steering mode and will set the direct steering mode and extinguish the light on the push on push off lighted pushbutton 122.

Referring to FIG. 6, the power electronics 116 converts the relatively low power signals from the autopilot controller 112 or the steering rate controller 115 into the relatively high power steering signal 105 to provide power to the steering controller 106.

Figure 10:
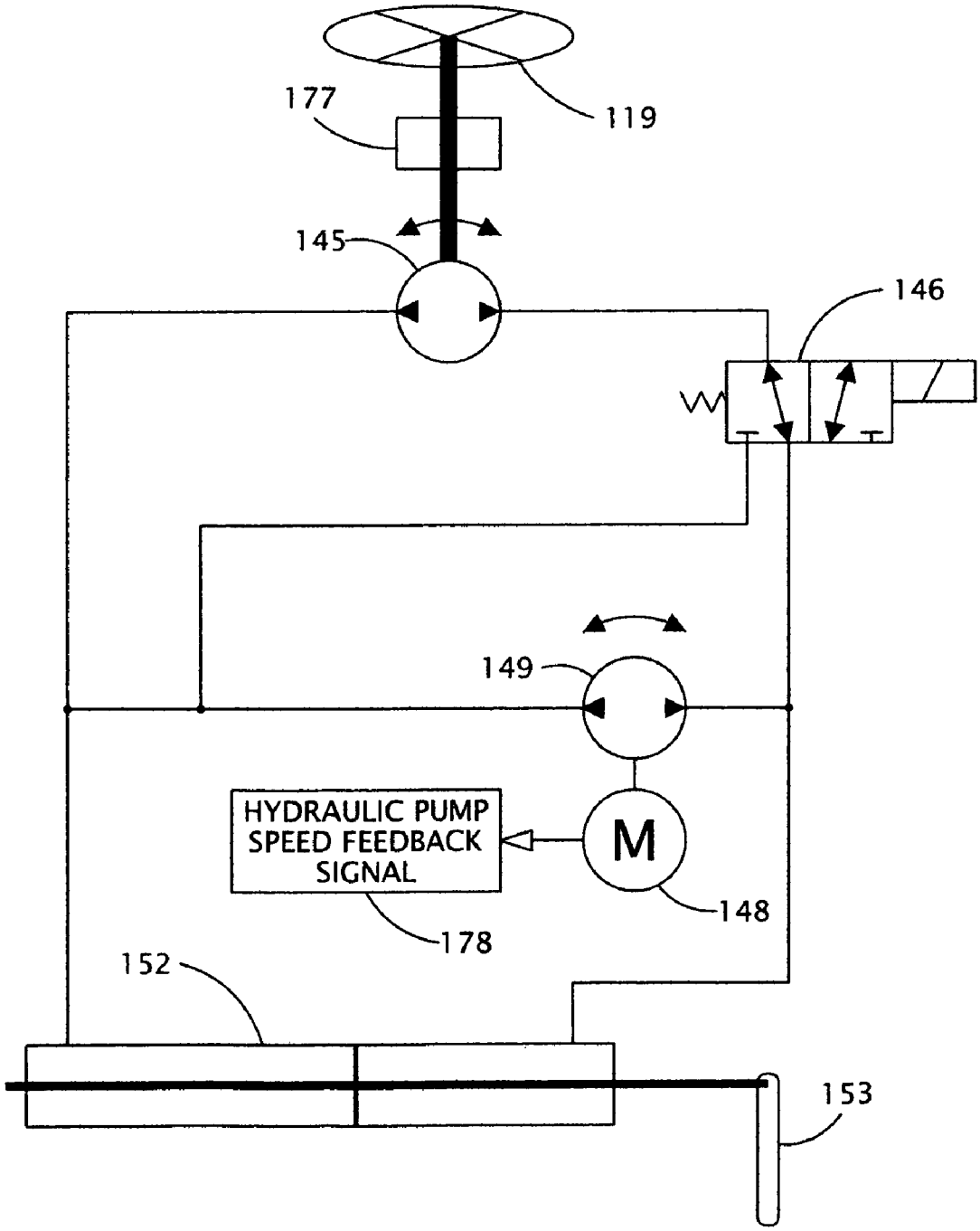
FIG. 10 is a hydraulic diagram of another embodiment of the steering controller 106 wherein a shaft encoder 177 is used to determine the rate of turning of a steering wheel 119 and a hydraulic motor voltage is used to provide speed feedback to a steering rate controller 115 and the autopilot controller 112.

Referring to FIGS. 6 and 10, the steering controller 106 provides the hydraulic pump speed feedback signal 178 to the autopilot controller 112 and to the steering rate controller 115 that indicate the speed of the hydraulic pump 149 and are used to provide the hydraulic pump speed feedback signal 178 to stabilize the controllers. The hydraulic pump speed feedback signal 178 can either be a signal from the hydraulic pump speed encoder 150 or, in another embodiment, a scaled motor voltage signal from the hydraulic pump motor 148.

FIG. 7 shows the flow diagram of the steering mode selector 176 of the preferred method of using the present invention having the direct steering mode, the autopilot steering mode, and the steering rate mode. When the power is applied (step 155), the pushbutton is initially not lighted (step 156). The process continues by disabling the steering rate mode (step 158) and the autopilot steering mode (step 159), and setting the system to the direct steering mode (step 160). The status of the pushbutton is checked (step 161) and if the pushbutton was not lighted (step 156), the direct steering mode is maintained.

FIG. 7 shows the flow diagram of the steering mode selector 176 wherein the invention can be placed in the autopilot steering mode. When the push on push off lighted pushbutton 122 is pressed (step 161), it is sensed in step 156. The autopilot controller parameter signal 117 is checked (step 162) to determine if the autopilot controller parameter signal 116 has a significant reset windup which would indicate that the boat is maneuvering very slowly, stopped, or operating in reverse in which case the push on push off lighted pushbutton light would be extinguished (step 157), the steering rate mode would be disabled (step 158), the autopilot steering mode would be disabled (step 159) and the system would be placed in the direct steering mode (step 160). Additionally, the steering rate controller parameter signal 118 is checked (step 163) to determine if the steering rate controller parameter signal 118 has significant reset windup in which case the system would also be placed in the direct steering mode. If the autopilot controller parameter signal 117 is normal (step 162) and the steering rate controller parameter signal 118 is normal (step 163), the direct steering mode is disabled (step 164) and the push on push off lighted pushbutton light is lighted (step 165). The steering device means 102 is checked to ensure that the steering device means 102 is not being operated (step 166). If the device is not presently in the autopilot steering mode (step 167), the steering rate mode is disabled (step 168), the heading set signal 111 is set (step 169), the autopilot steering mode is enabled (step 170) and the autopilot controller 112 is enabled (step 171). If during step 167 the system is already in the autopilot steering mode, the status of the push on push off lighted pushbutton 122 is checked (step 161) again and the cycle is repeated.

FIG. 7 shows the flow diagram of the steering mode selector 176 wherein the invention can be placed in the steering rate mode. When the push on push off lighted pushbutton 122 is pressed (step 161), it is sensed in step 156. The autopilot controller parameter signal 117 is checked (step 162) to determine if the autopilot controller parameter signal 117 has a significant windup which would indicate that the boat is maneuvering very slowly, stopped, or operating in reverse in which case the push on push off lighted pushbutton light would be extinguished (step 157), the steering rate mode would be disabled (step 158), the autopilot steering mode would be disabled (step 159) and the system would be placed in the direct steering mode. Additionally, the steering rate controller parameter signal 118 is checked (step 163) to determine if the steering rate controller parameter signal 118 has significant reset windup occurring in which case the system would also be placed in the direct steering mode. If the autopilot controller parameter signal 117 is normal (step 162) and the steering rate controller parameter signal 118 is normal (step 163), the direct steering mode is disabled (step 164) and the push on push off lighted pushbutton light is lighted (step 165). When the steering device means 102 is checked for operation (step 166), and operation is occurring, the system is checked to see if it is already in the steering rate mode (step 172). If the system is not in the steering rate mode, the autopilot steering mode is disabled (step 173), the system is placed into the steering rate mode (step 174) and the steering rate controller 115 is enabled (step 175). If during step 172, the system is already in the steering rate mode, the status of the push on push off lighted pushbutton 122 is checked (step 161) again and the cycle is repeated.

Figure 8:
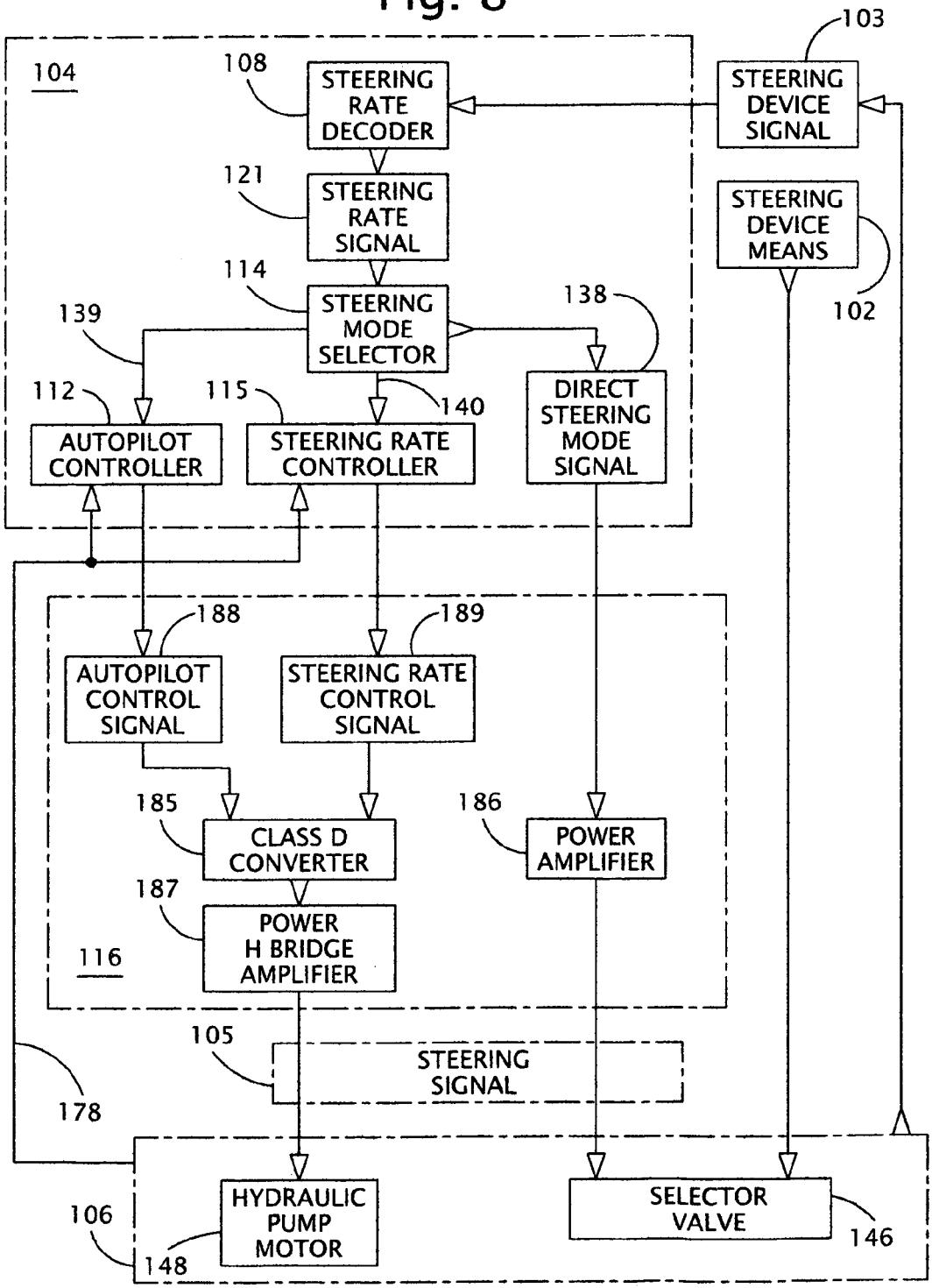
FIG. 8 is an operational block diagram of the invention that focuses on the operation of a power electronics 116.

Referring to FIG. 8, this block diagram shows the preferred embodiment operation of the power electronics 116 and the connection to other elements such as the central control unit 104 and the steering controller 106. The steering device means 102 is hydraulically connected to the selector valve 146 located in the steering controller 106. The steering device signal 103 is obtained from the steering controller 106 and is applied to the steering rate decoder 108. The steering rate decoder 108 essentially computes the derivative of the steering device signal 103 to derive the steering rate signal 121. If the value of the steering rate signal 121 is essentially zero, the steering mode selector 114 will enable the autopilot controller 112 to provide the autopilot control signal 188 to the power electronics 116. If the steering rate signal 121 is not zero, the steering mode selector 114 will enable the steering rate controller 115 to provide the steering rate control signal 189 to the power electronics 116.

Referring to FIG. 8, either the autopilot control signal 188 or the steering rate control signal 189 is applied to the class D converter 185. The class D converter 185 converts the relatively small autopilot control signal 188 and steering rate control signal 189 into the class D signal that can be applied to the power H bridge amplifier 187. The power H bridge amplifier 187 provides the power to drive the hydraulic pump motor 148 located in the steering controller 106.

Referring to FIG. 8, the direct steering mode signal 138 along with the power amplifier 186 is used to power the selector valve 146 located in the steering controller 106. While in the direct steering mode, the direct steering mode signal 138 is approximately zero. In the automatic mode, the direct steering mode signal 138 is at a high value resulting in power out of the power amplifier 186 that subsequently energizes the selector valve 146.

Figure 9:
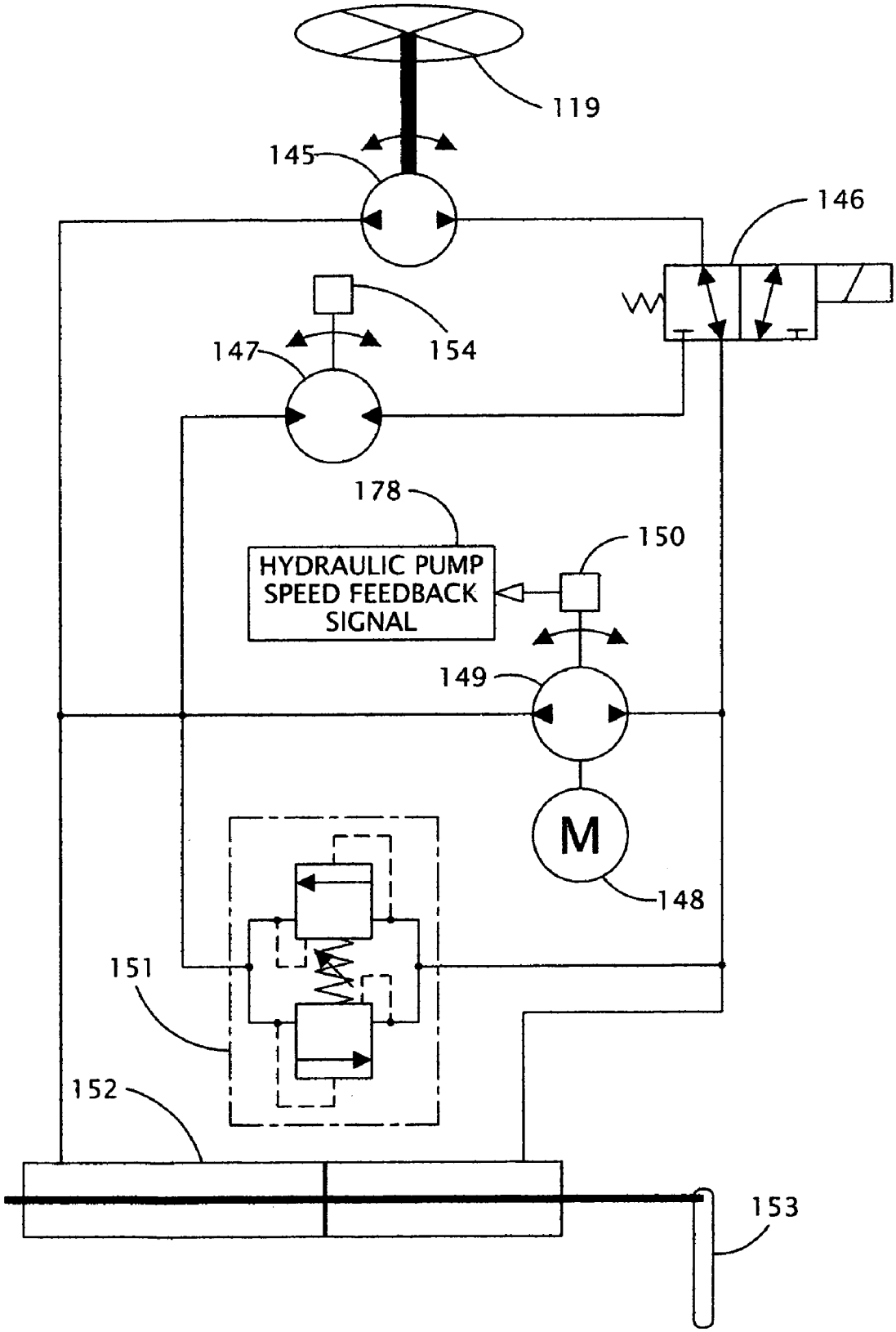
FIG. 9 is a hydraulic diagram of the preferred embodiment of a steering controller 106.

Referring to FIG. 9, this hydraulic diagram shows the preferred embodiment for the physical implementation of the device. The steering wheel 119 is physically connected to the helm pump 145. If selector valve 146 is deenergized, the helm pump 145 directly drives the hydraulic steering cylinder 152 actuating the rudder 153. This condition occurs when the device is in the direct steering mode. Selector valve 146 is only energized when the device is in the autopilot steering mode or the steering rate mode. The bi-directional relief valve 151 insures that the steering signal 105 to the hydraulic steering cylinder 152 does not become excessive and damage the hydraulic or mechanical components.

Referring to FIGS. 8 and 9, when the selector valve 146 is energized, turning the steering wheel 119 directs hydraulic oil from the helm pump 145 through the selector valve 146 and through the hydraulic motor 147 which drives the hydraulic motor speed encoder 154 to provide the steering device signal 103 to the steering rate decoder 108. The steering signal 105 from the power electronics 116 provides the power to drive the hydraulic pump motor 148 and the selector valve 146. The hydraulic pump motor 148 drives the hydraulic pump 149 providing hydraulic oil to the hydraulic steering cylinder 152 that subsequently drives the rudder 153. The hydraulic pump 149 also drives the hydraulic pump speed encoder 150 that provides the hydraulic pump speed feedback signal 178 to the steering rate controller 115 and the autopilot controller 112 to stabilize the PID operation of the controllers.

Referring to FIGS. 6 and 9, when the selector valve 146 is energized and the steering device means 102 is not being actuated, the device is in the autopilot steering mode. The hydraulic pump motor 148 is driven by the steering signal 105 from the power electronics 116 which receives a control signal from the autopilot controller 112. The hydraulic pump speed encoder 150 provides the hydraulic pump speed feedback signal 178 to the autopilot controller 112.

In an alternative embodiment, referring to FIGS. 6 and 10, the invention is increasingly simplified. When the selector valve 146 is de-energized, the steering wheel 119 and helm pump 145 directly control the hydraulic steering cylinder 152 that directly controls the rudder 153 that steers the boat. When the selector valve 146 is energized, the boat is in the automatic mode and the power electronics 116 provides power to the hydraulic pump motor 148 which powers the hydraulic pump 149 which positions the hydraulic steering cylinder 152 that activates the rudder 153 to control the steering of the boat. The hydraulic pump motor 148 provides the hydraulic pump speed feedback signal 178 in the form of a motor voltage feedback signal to the autopilot controller 112 and the steering rate controller 115. When the boat operator turns the steering wheel 119, the shaft encoder 177 provides the steering device signal 103 to the steering rate decoder 108 to obtain the steering rate signal 121 to the steering mode selector 114 which in turn enables the steering rate mode.

Figure 11:
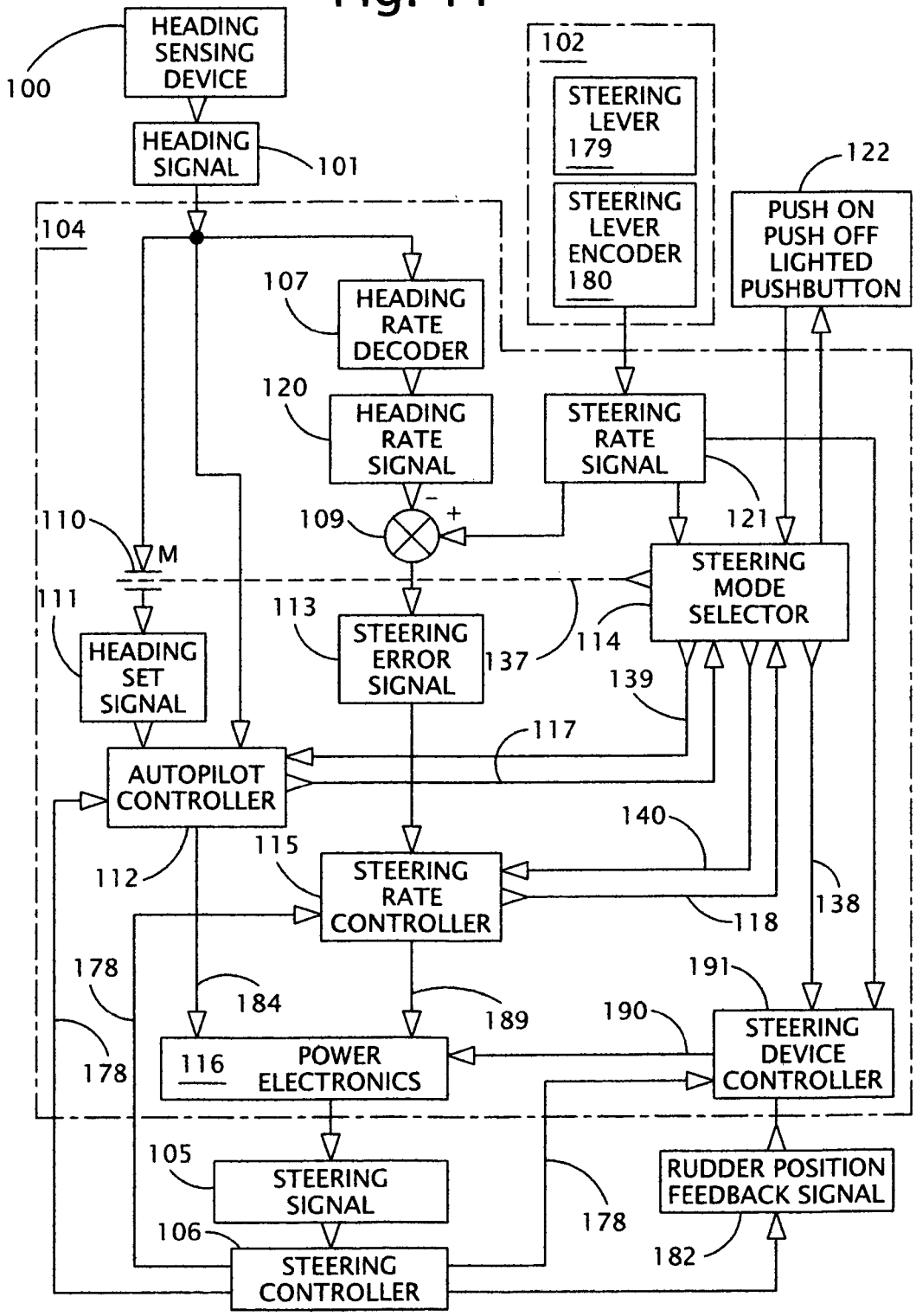
FIG. 11 is an operational block diagram of another embodiment of the invention that employs the steering lever 179 as a steering device means 102.

In an alternative embodiment, referring to FIG. 11, the invention is shown utilizing the steering lever 179 and the steering lever encoder 180 as the steering device means 102. The steering lever encoder 180 directly provides the steering rate signal 121 to the steering mode selector 114, the difference amplifier 109, and to the steering device controller 191. The steering device controller 191 provides the steering device control signal 190 to the power electronics 116. The steering controller 106 also provides the hydraulic pump speed feedback signal 178 and the rudder position feedback signal 182 to the steering device controller 191. All other aspects of the block diagram of this alternative embodiment are identical to the preferred embodiment block diagram depicted in FIG. 6.

Figure 12:
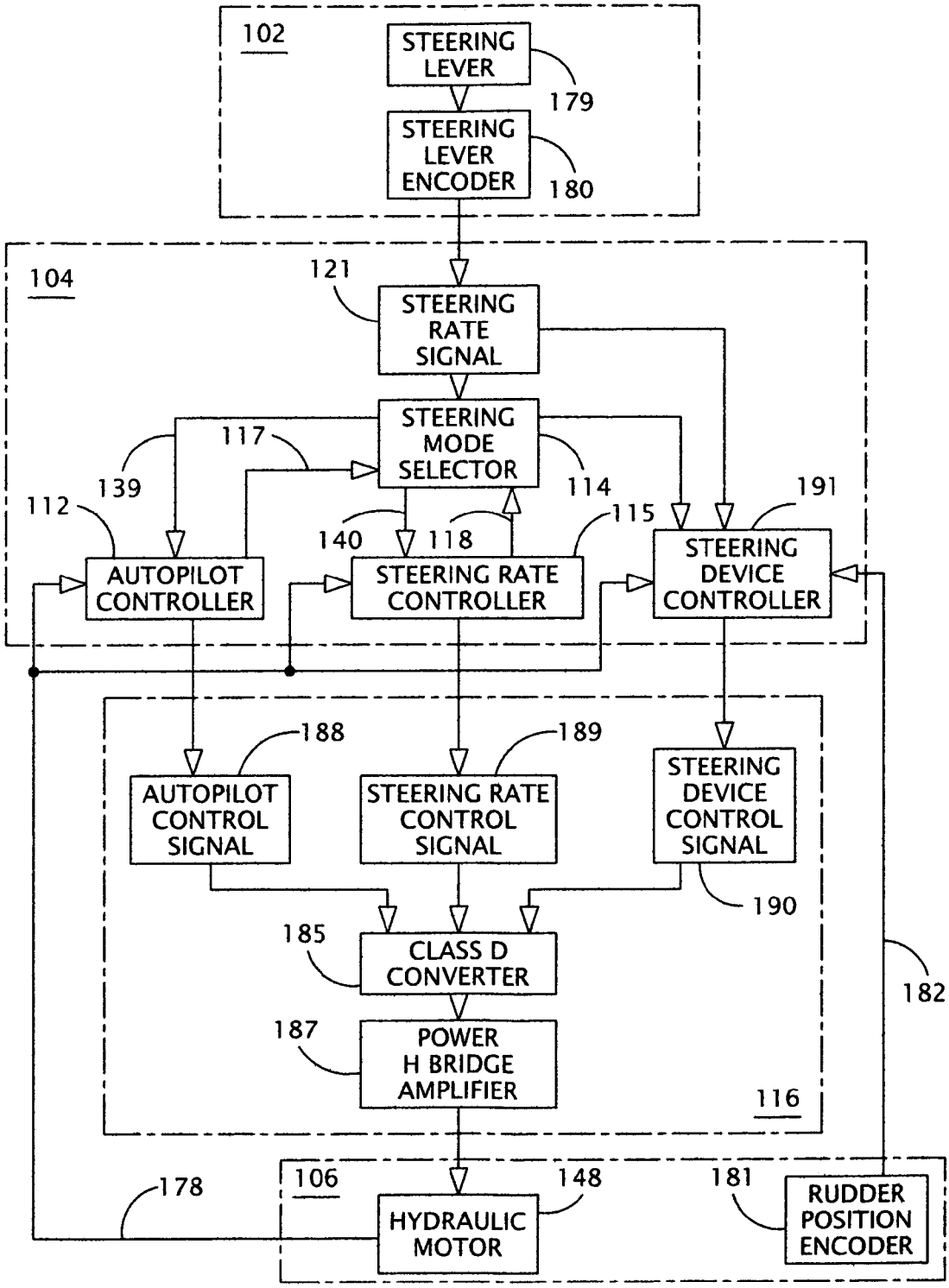
FIG. 12 is an operational block diagram of the invention that focuses on the operation of the power electronics 116 when using the steering lever 179 as the steering device means 102.

Referring to FIG. 12, the alternative embodiment employing the steering lever 179 shows the block diagram of the essential components comprising the central control unit 104 and the power electronics 116. Unlike other embodiments, the steering lever 179 cannot directly control the rudder 153 without a source of power. In this embodiment, power will always be required to steer the boat. As a result, the steering rate signal 121 is also applied to the steering device controller 191 that provides the steering device control signal 190. The steering device controller 191 in conjunction with the class D converter 185 and the power H bridge amplifier 187 provides the necessary components to implement the direct steering mode whereby the steering lever 179 can steer the boat as if the steering lever 179 were directly connected to the rudder 153. As shown in the FIG. 12 block diagram, the operation of the steering mode selector 114, the autopilot controller 112, and the steering rate controller 115 are unchanged.

Figure 13:
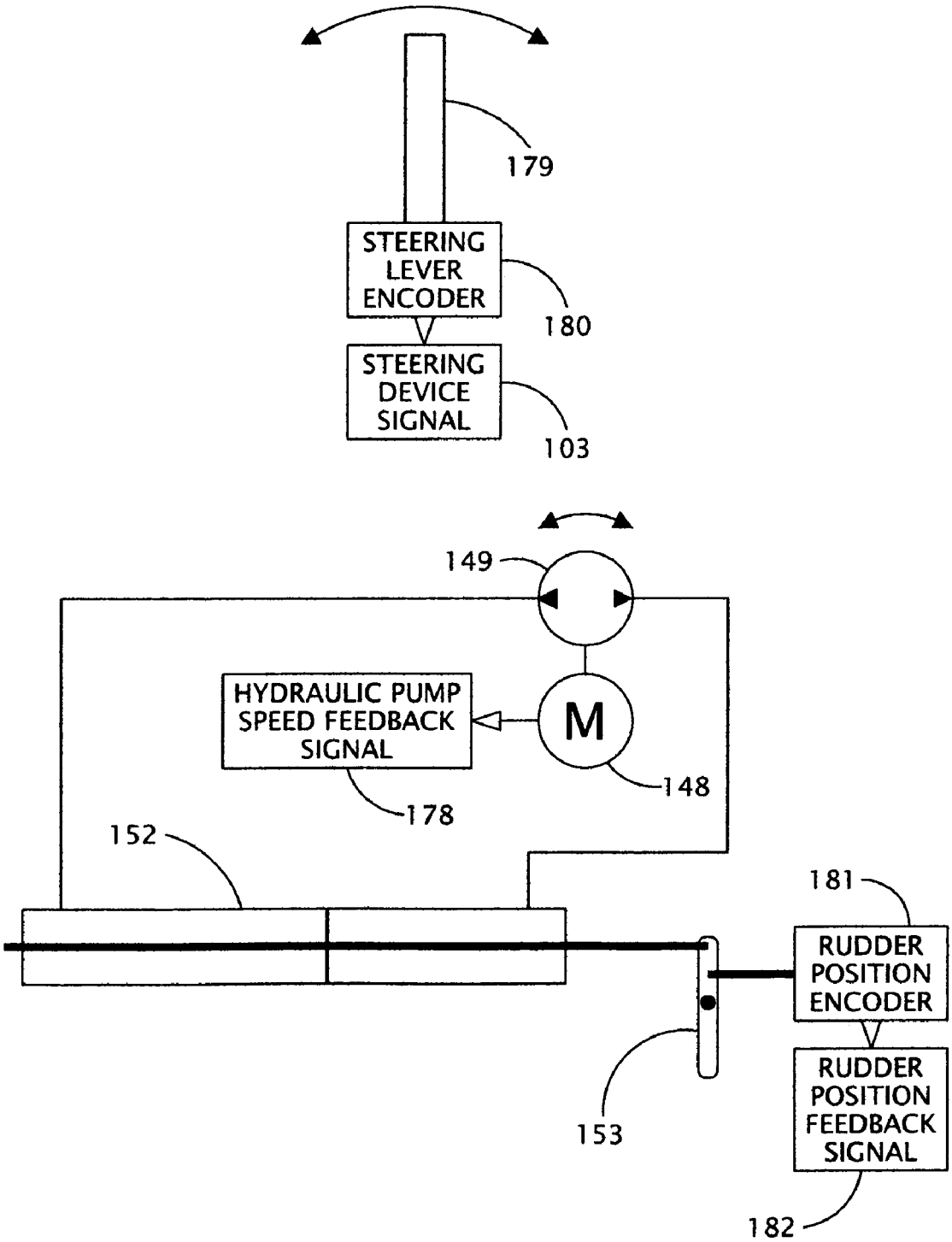
FIG. 13 is a hydraulic diagram of another embodiment of the steering controller 106 wherein the steering lever 179 is used as the steering device means 102.

Referring to FIG. 13, the alternative embodiment employing the steering lever 179 shows a block diagram of the essential components of the steering controller 106. The hydraulic pump 149 is shown directly activating the hydraulic steering cylinder 152 and subsequently turning the rudder 153.

Referring to FIGS. 12 and 13, the hydraulic pump speed feedback signal 178 is used to stabilize the operation of the autopilot controller 112, the steering rate controller 115, and the steering device controller 191. The rudder 153 is physically connected to the rudder position encoder 181 that provides the rudder position feedback signal 182 to the steering device controller 191. The rudder position feedback signal 182 and the steering rate signal 121 provide the signals to the steering device controller 191 that is essentially a PID controller whereby the position of the rudder 153 closely follows the position of the steering lever 179.

While the invention has been described with reference to several illustrative embodiments, these descriptions are not intended to be construed in a limited sense. Various modifications in combination with other embodiments of the invention will be apparent to persons skilled in the art upon reference to the description. For example, other type of steering devices and heading sensing devices are in common practice. Although the preferred embodiment has shown the device integrated with a hydraulic system, electric actuators are also frequently used throughout industry. The present invention may be manufactured with any combination of heading sensing devices, steering device means, or rudder actuation devices.

What is claimed is:

1. An apparatus for controlling the rate of turning of a boat comprising:

a central control unit;

a heading sensing device which will provide the heading of said boat and is in predetermined electrical communication with said central control unit;

a steering controller which will physically control the steering of said boat and is in predetermined electrical communication with said central control unit; and a steering device means which will provide a means for an operator to steer said boat and is in predetermined electrical communication with said central control unit;

wherein said central control unit in conjunction with said steering device means and said heading sensing device calculates a steering signal which is predeterminedly electrically communicated to said steering controller and can turn said boat in the approximate direction and heading rate that is approximately proportional to the direction and rate that said steering device means is being operated by said operator and;

wherein said central control unit in conjunction with said heading sensing device calculates said steering signal which is predeterminedly electrically communicated to said steering controller and can steer said boat approximately on the course that said boat was heading at approximately the time said steering device means ceased to be operated by said operator.

2. The apparatus of claim 1, wherein said steering device means further comprises:

wherein said steering device means is selected from the group consisting of a steering wheel and a steering lever; and wherein a steering device signal is provided by said steering device means which is dependent upon the approximate speed of rotation and direction of said steering wheel; and wherein said steering device signal is provided by said steering device means which is dependent upon the approximate steering lever angle and direction of said steering lever; and wherein said steering device means predeterminedly electrically communicates said steering device signal to said central control unit.

3. The apparatus of claim 1, wherein said heading sensing device further comprises:

a global positioning system receiver;

a tilt compensated compass; and a gyroscope;

wherein a heading signal is provided by said heading sensing device that is compensated for the tilt and trim of said boat; and wherein said heading sensing device predeterminedly electrically communicates said heading signal to said central control unit.

4. The apparatus of claim 1, wherein said steering controller further comprises:

wherein said steering controller is selected from the group consisting of a rudder, a water jet, and an outboard motor; and wherein said steering signal is predeterminedly electrically communicated by said central control unit to said steering controller to determine the heading of said boat.

5. The apparatus of claim 1, and further comprising:

wherein said central control unit is in predetermined electrical communication with said steering device means; and wherein said steering device means provides said steering device signal to said central control unit; and wherein said central control unit is in predetermined electrical communication with said heading sensing device; and wherein said heading sensing device provides said heading signal to said central control unit; and wherein a heading rate signal is calculated from said heading signal obtained from said heading sensing device; and wherein said central control unit is in predetermined electrical communication with said steering controller; and wherein said central control unit provides said steering signal to said steering controller; and wherein said central control unit calculates said steering signal from said steering device signal obtained from said steering device means and from said heading rate signal obtained from said heading signal when said steering device means is being operated by said operator; and wherein said central control unit calculates said steering signal from said heading signal obtained from said heading sensing device when said steering device means ceases to be operated by said operator; and wherein said steering signal is predeterminedly electrically communicated from said central control unit to said steering controller.

6. A method for controlling the direction of a boat during a turning maneuver comprising the steps of:

increasing a steering device means output thereby increasing a steering device signal to a central control unit resulting in a correction to a steering signal sent to a steering controller and increasing the rate of turning of said boat in the direction of said steering device means while a heading sensing device provides a heading signal which is compared to said steering device signal by said central control unit thus providing a means to calculate said steering signal to said steering controller to control the approximate turning rate of said boat in a manner wherein the rate at which said steering device means is operated is approximately proportional to the rate of turning of said boat, conversely decreasing said steering device means output thereby decreasing said steering device signal to said central control unit resulting in a correction to said steering signal sent to said steering controller and decreasing the rate of turning of said boat in the direction of said steering device means while said heading sensing device provides said heading signal which is compared to said steering device signal by said central control unit thus providing a means to calculate said steering signal to said steering controller to control the approximate turning rate of said boat in a manner wherein the rate at which said steering device means is operated is approximately proportional to the rate of turning of said boat.

* * * * *